US005208087A

United States Patent [19]

Stigberg

[11] Patent Number: 5,208,087

[45] Date of Patent: May 4, 1993

[54] SPIRAL CONSTRUCTION FOR A LONG NIP PRESS BELT

[75] Inventor: Carl E. Stigberg, Schenectady, N.Y.

[73] Assignee: Albany International Corp., Albany, N.Y.

[21] Appl. No.: 773,120

[22] Filed: Oct. 8, 1991

[51] Int. Cl.[5] ..... B32B 3/10

[52] U.S. Cl. ..... 428/60; 428/167; 428/172; 428/217; 428/295; 156/137; 156/173; 162/358.4; 162/901

[58] Field of Search ..... 428/217, 60, 156, 167, 428/172, 246, 295; 156/137, 173; 162/358

[56] References Cited

U.S. PATENT DOCUMENTS 1,129,666 2/1915 Gray ..... 156/173 X
2,237,178 4/1941 Freeman ..... 156/173
4,908,103 3/1990 Cronin et al. ..... 428/217 X

FOREIGN PATENT DOCUMENTS 2538691 3/1977 Fed. Rep. of Germany ..... 156/137

*Primary Examiner*—Alexander S. Thomas
*Attorney, Agent, or Firm*—Kane, Dalsimer, Sullivan, Kurucz, Levy, Eisele and Richard

[57] ABSTRACT

A belt for use on a long nip press for dewatering a fibrous web may be manufactured by winding an elongated strip onto a pair of process rolls to form a closed helix. Adjacent coils of the closed helix are bound to one another with an adhesive. The elongated strip includes a reinforcing web coated on one side with a uniformly smooth coating of a polymeric resin. The other side of the reinforcing web is coated with another polymeric resin of higher hardness value, and is provided with grooves. The elongated strip is wound onto the process rolls to produce a belt with a grooved outer surface. The method facilitates the manufacture of belts of a variety of widths and lengths.

12 Claims, 3 Drawing Sheets

SPIRAL CONSTRUCTION FOR A LONG NIP PRESS BELT

BACKGROUND OF THE INVENTION

1. Field of the Invention

The present invention relates to mechanisms for extracting water from a web of material, and, more particularly, from a fibrous web being processed into a paper product on a papermaking machine. Specifically, the present invention is an impermeable belt designed for use on a long nip press on a papermaking machine, and a method for constructing the impermeable belt.

2. Description of the Prior Art

During the papermaking process, a fibrous web is formed on a forming wire by depositing a fibrous slurry thereon. A large amount of water is drained from the slurry during this process, after which the newly formed web, left behind on top of the forming wire, proceeds to a press section. The press section includes a series of press nips, in which the fibrous web is subjected to compressive forces designed to remove additional water therefrom. The web finally proceeds to a drying section, which includes heated dryer drums around which the web is directed. The heated dryer drums reduce the water content of the web to a desirable level through evaporation, thereby completing the manufacture of a paper product.

Rising energy costs have made it increasingly desirable to remove as much water as possible from the web prior to its entering the dryer section. The dryer drums are typically heated from within by steam and related costs can be substantial, especially when a large amount of water needs to be removed from the web.

Traditionally, press sections have included a series of nips formed by pairs of adjacent cylindrical press rollers. In recent years, the use of long press nips has been found to be advantageous over the use of nips formed by pairs of adjacent rollers. Long press nips are so called because they have a greater extent in the longitudinal, or machine, direction than those formed by pairs of adjacent rollers. The longer the web can be subjected to pressure in the nip, the more water can be removed there, and, consequently, the less will remain to be removed through evaporation in the dryer section. This is accomplished in a long press nip by virtue of the fact that any given portion of the fibrous web takes a longer time to pass through the nip.

The present invention relates to long nip presses of the shoe type. In this variety of long nip press, the nip is formed between a cylindrical press roller and an arcuate pressure shoe. The latter has a cylindrically concave surface having a radius of curvature close to that of the cylindrical press roller. When roller and shoe are bought into close physical proximity, a nip is formed which can be five to ten times longer in the longitudinal, or machine, direction than one formed between two press rollers. This increases the so-called dwell time of the fibrous web in the long nip while maintaining the same level of pressure per square inch pressing force used in a two-roller press. The result of his new long nip technology has been a dramatic increase in dewatering of the fibrous web in the long nip when compared to conventional nips on paper machines.

A long nip press of the shoe type requires a special belt, such as that shown in U.S. Pat. No. 4,946,731 to Dutt. This belt is designed to protect the press fabric supporting, carrying, and dewatering the fibrous web from the accelerated wear that would result from direct, sliding contact over the stationary pressure shoe. Such a belt must be made with a smooth impervious surface that rides, or slides, over the stationary shoe on a lubricating film of oil. The belt moves through the nip at roughly the same speed as the press fabric thereby subjecting the press fabric to minimal amounts of rubbing against stationary components of the press.

A typical configuration for a long nip press involves the use of two press fabrics. The components in the nip can be listed in the following sequence: a grooved cylindrical press roller, a first press fabric, the fibrous web or nascent paper sheet, a second press fabric, the special belt, the lubricating film, and the arcuate pressure shoe.

Many of the long nip presses currently in commercial operation are of the above configuration. However, this so-called double-felted long nip press is limited to certain types of paper grades. To expand the application of the long nip press to finer paper grades and newsprint, it will be necessary to develop a single-felted long nip press.

In a single-felted long nip press, the components in the nip would be listed in the following sequence: a smooth cylindrical press roller, the fibrous web or nascent paper sheet, the press fabric, the special belt, the lubricating film, and the arcuate pressure shoe. As implied by this sequence, the fibrous web actually contacts the cylindrical press roller in a single-felted long nip press.

In the double-felted long nip press, the water pressed from the fibrous web can pass into either of the two press fabrics, as well as into the grooves provided in the cylindrical press roller. In the single-felted long nip press, two of these sinks for water storage have been eliminated. There is only one felt and, because the fibrous web contacts the cylindrical press roller directly, this roller must have a smooth surface. Clearly, this loss of temporary water storage space must be made up in another fashion, because it is absolutely mandatory that voids be provided in the nip of the press, so that water pressed from the paper sheet in a single-felted long nip press will have a place to go.

Two approaches have been taken to achieve a satisfactory solution of this problem. Canadian Patent No. 1,190,779 shows a long nip press belt having voids on the felt side. These voids arise from the weave pattern of the base fabric and the absence of impregnation o the felt side of the belt, and provide a place into which liquid can be transferred during passage of the fibrous web, press fabric, and special belt through the nip.

The other approach is represented by the previously noted U.S. Pat. No. 4,946,731. This shows a long nip press belt having grooves on the side facing the felt, or press fabric, to store water pressed from the fibrous web.

While these two approaches were directed primarily toward achieving a solution to the water-removal problem in a single-felted long nip press, it has been found that us of either belt in a double-felted long nip press leads to enhanced dewatering.

The second of the these two approaches has proven to be the more viable, yet grooved long nip press belts are susceptible to a whole new set of problems. Common belt failures are caused by delamination and collapse of the grooves. In the case of the former, it is more accurate to say that the so-called land areas, which remain on the surface of the belt when the grooves are cut and which separate the grooves to some degree, peel from the surface of the belt in long strands. Not only does this leave the belt grooveless, but the long strands, the peeled land areas, also become entangled in the papermachine components. The invention shown in U.S. Pat. No. 4,946,731 provides a solution to the problem of delamination by anchoring the land areas to the belt with staple fibers from the spun yarns used to weave its base fabric.

The grooves may collapse under the elevated compression to which the belt is subjected in the nip. Here, it is more accurate to say that the land areas separating the grooves partially or completely flatten in the nip, closing the grooves to some degree, thereby reducing their effectiveness as a temporary storage place for water.

The manufacture of long nip press belts also presents difficulties. Typically, an endless base fabric must be provided in the dimensions required for a specific long nip press. That is to say, the endless base fabric must have a width, measured transversely thereacross, equal to that of the long nip press, and a length, measured longitudinally therearound, sufficient to permit the belt to be trained about all the tension and guide rolls on the press. As a consequence, each long nip press belt is to a large extent a unique item, making it difficult to streamline the process whereby belts of different size are manufactured.

The present invention includes a method for manufacturing long nip press belts of varying transverse and longitudinal dimensions, which does not require the provision of an endless base fabric in the dimensions required for a specific long nip press. As a consequence, long nip press belts may be readily and quickly manufactured for a variety of different presses on a single apparatus with common materials.

The present invention also includes a belt made in accordance with the method. The belt, in addition to its ease of manufacture, is also less susceptible to delamination and collapse of its grooves than the belts of the prior art.

SUMMARY OF THE INVENTION

The long nip press belt of the present invention is constructed by winding an elongated strip around and between a pair of process rolls to produce a closed helix having a desired length, as measured longitudinally around the closed helix, and a desired width, as measured transversely across the closed helix.

The elongated strip, which has a constant width and a uniform thickness, includes a reinforcing web, which may be a narrow strip of woven fabric, having a first side and a second side. The first side is coated with a first coating of a first polymeric resin, this first coating being uniformly smooth.

The second side of the reinforcing web is coated with a second coating of a second polymeric resin, which has a hardness value greater than that of the first polymeric resin. The second coating has at least one groove in a longitudinal direction along the elongated strip. The thickness of the elongated strip, as measured from the surface formed by the first coating to the outer surface of the land areas separating the grooves in the second coating, is uniform.

As noted above, the present belt is manufactured using a pair of process rolls. These process rolls are rotatable about their respective axes, and are situated such that their axes are parallel to one another. The distance separating the process rolls is set and determines the length of the belt, as measured longitudinally therearound, to be manufactured.

The manufacture of a belt is begun by extending the elongated strip from one of the process rolls toward the other process roll, around that other process roll, and back to the first roll, to form a first coil of a closed helix which becomes the final belt. To form this first, and all subsequent, coils of the closed helix, the uniformly smooth first coating on the elongated strip faces the process rolls and ultimately forms the inner surface of the closed helix.

Once such a first coil has been formed, it is closed by joining the edge of the elongated strip adjacent to the beginning thereof to the edge of the elongated strip at the point being wound onto the process roll. Then, manufacture proceeds by rotating the process rolls in a common direction to produce subsequent coils by winding the elongated strip onto the process rolls, while continuously joining the edge of the elongated strip where just being wound onto the process rolls to that which has already been wound thereabout.

When this has continued from the time required to produce a closed helix of the desired width, as measured transversely thereacross, the elongated strip, not yet wound onto the process rolls and no longer required, is cut, leaving the complete closed helix of desired length and width on the process rolls. It is then removed therefrom to provide a belt suitable for use as a long nip press belt on a papermachine.

The present invention will now be described in more complete detail with frequent reference being made to the following set of figures.

DETAILED DESCRIPTION OF THE PREFERRED EMBODIMENT

Figure 1:
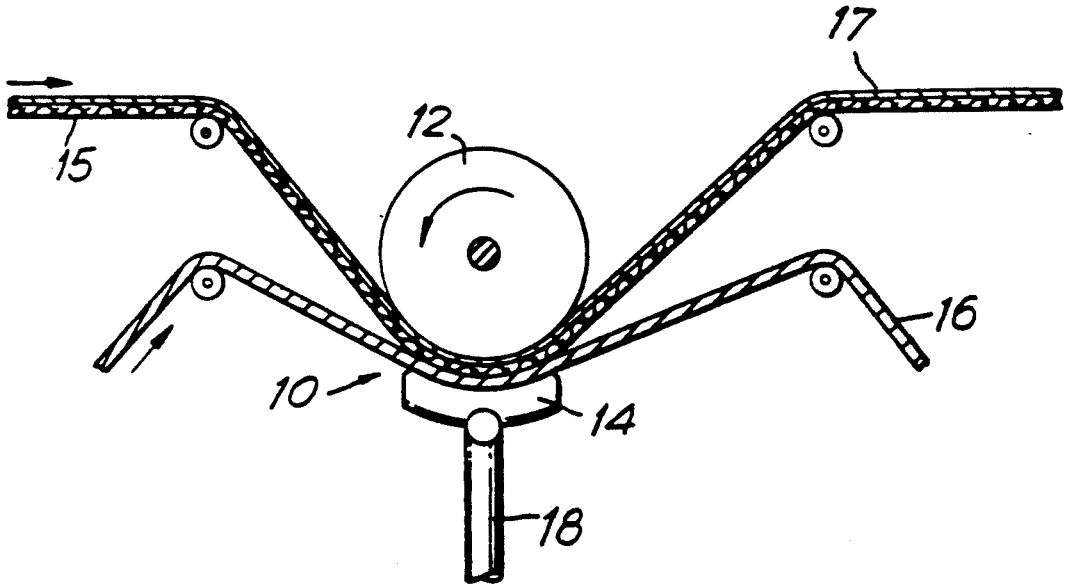
FIG. 1 is a side elevational view of a long press nip for which the belt of the present invention is designed.
Figure 2:
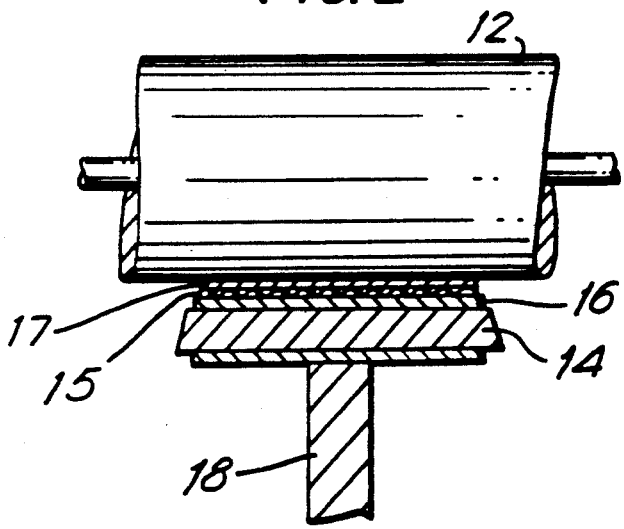
FIG. 2 is a partially sectioned front view of the press nip shown in FIG. 1.

A single-felted long nip press for dewatering a fibrous web being processed into a paper product on a paper machine is shown in FIGS. 1 and 2. The press nip 10 is defined by a smooth cylindrical press roller 12, an arcuate pressure shoe 14, and a belt 16 of the present invention arranged such that it bears against the surface of the cylindrical press roller 12. The arcuate pressure shoe 14 has about the same radius of curvature as the cylindrical press roller 12. The distance between the cylindrical press roller 12 and the arcuate pressure shoe 14 may be adjusted by means of conventional hydraulic or mechanical apparatus, which is not shown, connected to rod 18 pivotally secured to arcuate pressure shoe 14.

The rod 18 may also be actuated to apply the desired pressure to the arcuate pressure shoe 14. It will be appreciated that the cylindrical press roller 12 and arcuate pressure shoe 14 described above and shown in FIGS. 1 and 2 are conventional in the art.

Also shown in FIGS. 1 and 2 are a papermaker's wet press fabric 15 and a fibrous web 17 being processed into a paper sheet. The motions of the belt 16, press fabric 15, fibrous web 17 and cylindrical press roller 12 are as indicated by the arrows in FIG. 1.

Figure 3:
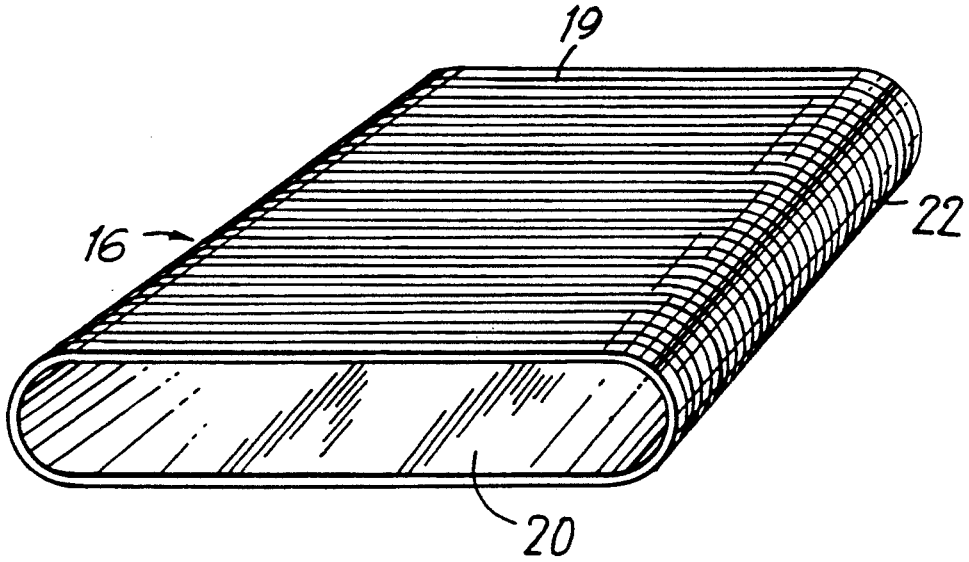
FIG. 3 is a plan view of the belt of the present invention.

A plan view of the belt 16 of the present invention is provided in FIG. 3. It has an outer surface 19 and an inner surface 20. The outer surface 19 is characterized by a plurality of grooves 22, while the inner surface 20 is uniformly smooth. Grooves 22 spiral in a substantially longitudinal direction around the length of the belt by virtue of the helical fashion in which the belt is constructed.

Figure 4:
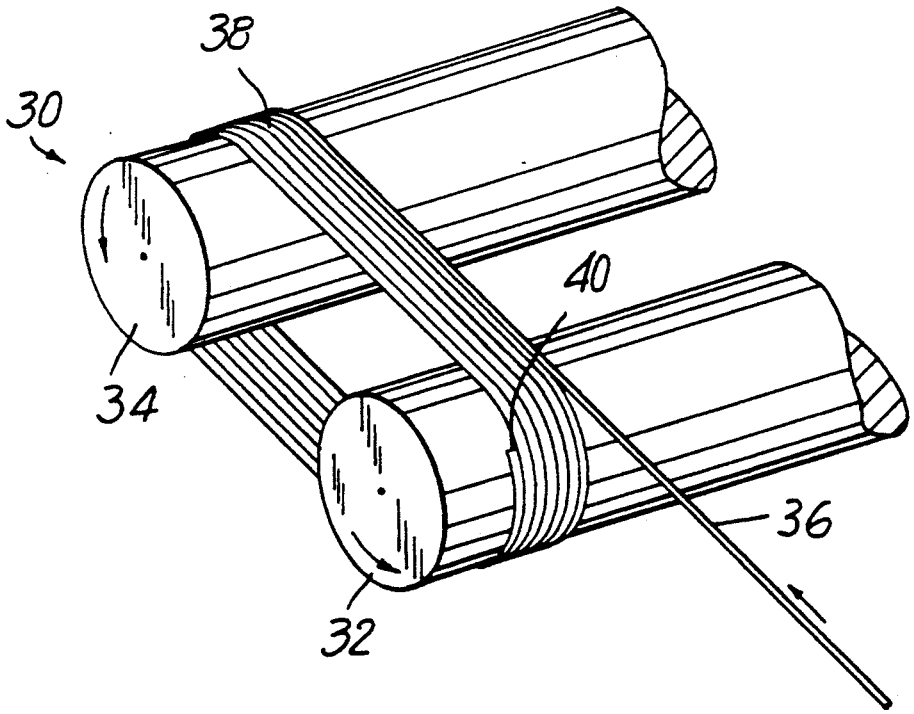
FIG. 4 illustrates the method by which the belt of the present invention may be manufactured.

The method by which the belt may be manufactured is illustrated in FIG. 4. The apparatus 30 includes a first process roll 32 and a second process roll 34, each of which is rotatable around its longitudinal axis. The first process roll 32 and the second process roll 34 are parallel to one another, and are separated by a distance, which will determine the overall length of the belt to be manufactured thereon, as measured longitudinally around the belt.

The belt is manufactured on apparatus 30 from an elongated strip 36, the details of which will be provided below during the discussion regarding FIGS. 5 through 7. To begin the manufacture of the belt, the beginning of the elongated strip 36 is extended in a taut condition from the first process roll 32 toward the second process roll 34, around the second process roll 34, and back to the first process roll 32 forming a first coil of a closed helix 38. To close the first coil of the closed helix 38, the beginning of the elongated strip 36 is joined to the elongated strip 36 just being wound onto the first process roll 32 by a suitable adhesive at point 40. This adhesive may be heat-activated.

Thereafter, subsequent coils of closed helix 38 are produced by rotating first process roll 32 and second process roll 34 in a common direction as indicated by the arrows in FIG. 4, while feeding the elongated strip 36 onto the first process roll 32. At the same time, the elongated strip 36 being freshly wound onto the first process roll 32 is continuously joined to that already on the first process roll 32 and the second process roll 34 by a suitable adhesive to produce additional coils of closed helix 38.

This process continues until the closed helix 38 has a desired width, as measured axially along the first process roll 32 or the second process roll 34. At that point, the elongated strip 36 not yet wound onto the first process roll 32 and the second process roll is cut, and the closed helix 38 produced therefrom is removed from the first process roll 32 and the second process roll 34 to provide the belt 16 of the present invention.

It will be noted that an endless base fabric is not a part of the belt 16 of the present invention, nor does such a base fabric need to be coated with a polymeric resin on one or both sides, in contrast to long nip press belts of the prior art. The method to produce the present belt is quite versatile and adaptable to the production of belts of a variety of longitudinal and transverse dimensions, since the same apparatus 30 and elongated strip 36 are always used. That is to say, the manufacturer, by practicing the present invention, need no longer produce an endless base fabric of appropriate width and length as a first step toward the manufacture of a belt for a given papermachine. Rather, the manufacturer need only set the first process roll 32 and the second process roll 34 the appropriate distance apart, to determine the length of the belt 16, and wind the elongated strip 36 onto the first process roll 32 and the second process roll 34 until the closed helix 3 has reached the desired width.

Figure 5:
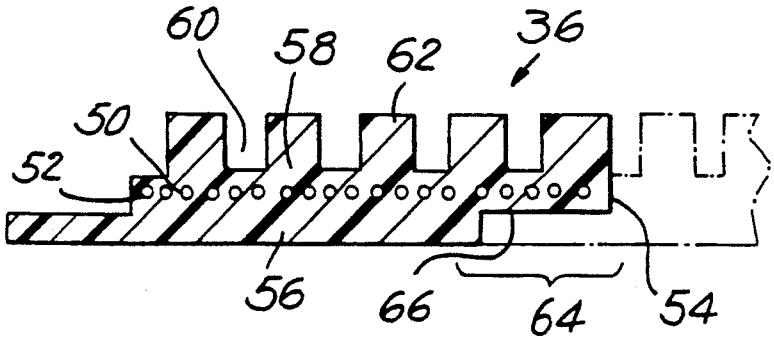
FIG. 5 is a cross section of the elongated strip having edges which form a buttress joint when wound into the form of a closed helix to produce the present belt.

Turning no to the construction of the elongated strip 36, FIG. 5 shows such a strip in cross section. The elongated strip first comprises a reinforcing web 50, which may be a narrow strip of woven fabric. Monofilament yarns extruded from any of the synthetic polymeric resins commonly used to manufacture yarns for papermachine fabrics are appropriate for use in weaving the required narrow strip of woven fabric for use as reinforcing web 50. Polyamide and polyester yarns are but two examples. The elongated strip 36 is of constant width and uniform thickness. The elongated strip 36 has a first edge 52 and a second edge 54.

The reinforcing web 50 has two sides, one of which is coated with a first coating 56 of a first polymeric resin. The first coating 56 is uniformly smooth, and, during the production of belt 16, forms the inner surface 20 thereof. The first coating 56 and the second coating 58 cooperate to completely impregnate the reinforcing web 50, thereby rendering the elongated strip 36 impermeable to fluids, such as lubricating oil and water The other side of reinforcing web 50 is coated with a second polymeric resin. The second polymeric resin has a hardness value greater than that of the first polymeric resin, so that the longitudinal grooves 60 provided in the second coating 58 may less readily collapse, when belt 16 produced from elongated strip 36 is in a press nip. The thickness of elongated strip 36, as measured from the surface of the first coating 56 to the tops of the land areas 62 between grooves 60 in the second coating 58, is uniform. As may now be observed, the grooves 22 in belt 16 in FIG. 3 spiral in a substantially longitudinal direction thereabout, because elongated strip 36, is wound into the form of closed helix 38 in FIG. 4 to produce belt 16.

For example, the first coating 56 of a first polymeric resin, which forms the inner surface 20 of belt 16 on its smooth or shoe side, may have a hardness value of 88 to 90 on the Shore A scale, or of 63 to 68 on the Shore C scale. The second coating 58 of a second polymeric resin, which has grooves 22 and forms the outer surface 19 of belt 16 on its grooved or felt side, may have a hardness value of 96 to 99 on the Shore A scale, or of 83 to 90 on the Shore C scale.

The elongated strip 36 may be manufactured by a process of composite extrusion, such as that used to manufacture some belting products. Elongated strip 36 may be from 1 inch to 6 inches wide, and 0.300 inch thick. Synthetic polymeric resins, such as 100% solid polyurethane resins, may be used in the composite extrusion process to provide the first coating 56 and the second coating 58.

With reference to FIG. 5, first edge 52 and second edge 54 of elongated strip 36 are formed so as to cooperatively provide a buttress joint 64 when elongated strip 36 coils are overlapped in winding closed helix 38. The interface 66 is wider than the thickness of elongated strip 36, and, when coated with an adhesive, provides a more effective bonding between successive coils of the closed helix 38.

Figure 6:
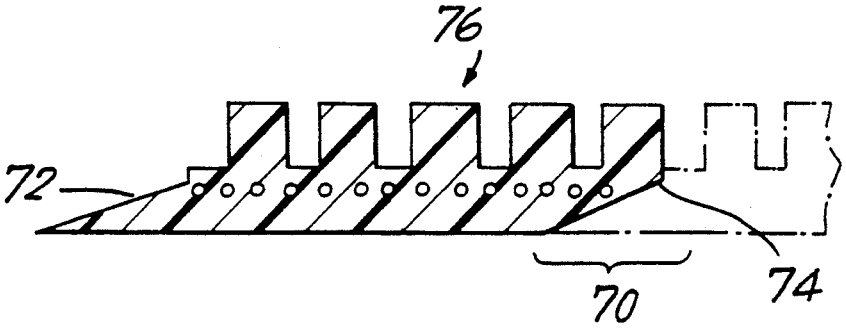
FIG. 6 is a cross section similar to that showing FIG. 5 wherein the elongated strip has edges which form a skived joint.
Figure 7:
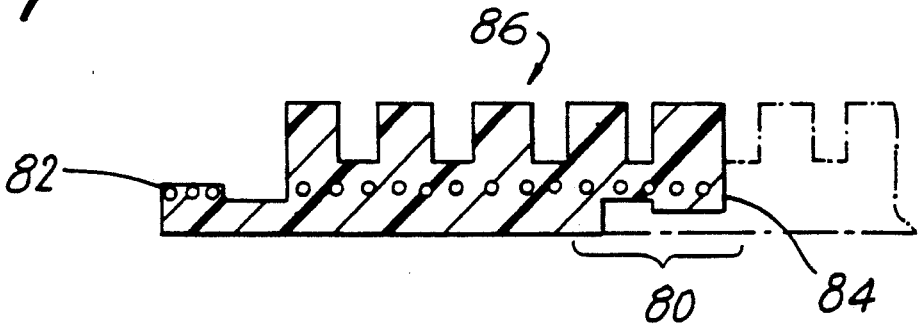
FIG. 7 is a cross section similar to those shown in FIGS. 6 and 7 wherein the elongated strip has edges which form an interlock joint.

FIGS. 6 and 7 show two additional joints for elongated strip coils. Turning first to FIG. 6, a skived joint 70 is formed by first edge 72 and second edge 74 of elongated strip 76. In all other details, elongated strip 76 is of the same construction as elongated strip 36. Similarly, an interlock joint 80 is shown in FIG. 7, and is formed by first edge 82 and second edge 84 of elongated strip 86. As before, all other details of elongated strip 86 are identical to those of elongated strips 36 and 76. As may be observed in FIG. 7, interlock joint 80 provides for a certain amount of geometrical retention between the first edge 82 and the second edge 84 of successive coils formed by elongated strip 86 to supplement that provided by the adhesive used to join the coils together.

A urethane-based adhesive may be used to secure adjacent coils of closed helix 38 to one another, particularly where the elongated strip 36 includes polyurethane resins, to ensure that finished belt 22 is impermeable.

As may now be recognized, in consequence of the manner in which the present belts are constructed, the present invention renders it no longer necessary to cut spiral or annular grooves in the coating on one side of an endless base fabric by mechanical means to produce same for a long nip press, as the elongated strip used to assemble the belt already is provided with the required grooves.

In the belts 16 of the present invention, there would preferably be six to eight grooves 22 per inch as determined by counting across the belt 16 in a direction transverse to the grooves 22. The depth of the grooves 22 would fall in the approximate range of from 0.060 inch to 0.100 inch; the width of the grooves 22 would fall in the approximate range of from 0.020 inch to 0.040 inch.

It will be readily understood that modifications to the above would be obvious to anyone skilled in the art without departing from the scope of the appended claims.

What is claimed is:

1. A method for manufacturing a belt for use as a long nip press belt on a long nip press in a papermachine comprising the steps of:

providing a first process roll and a second process roll, said first process roll and said second process roll being rotatable about their respective axes;

positioning said first process roll and said second process roll at a fixed distance from one another, said axes of said first process roll and said second process roll being parallel to one another;

providing an elongated strip from which said belt may be manufactured, said elongated strip having a beginning, a first edge and a second edge, a constant width, and a uniform thickness, said elongated strip including a reinforcing web having a first side and a second side, wherein said first side is coated with a first coating of a first polymeric resin, said first coating being uniformly smooth, and wherein said second side of said reinforcing web is coated with a second coating of a second polymeric resin, said second polymeric resin having a hardness value greater than that of said first polymeric resin, said second coating having at least one groove in a longitudinal direction along said elongated strip;

forming a first coil of a closed helix from said elongated strip by extending said beginning of said elongated strip in a taut condition from said first process roll, around said second process roll, and back to said first process roll, said first coating of said elongated strip facing said first process roll and said second process roll;

joining said first edge of said elongated strip at said beginning of said elongated strip to s id second edge of said elongated strip on said first process roll to close said first coil;

rotating said first process roll and said second process roll in a common direction to form additional coils of said closed helix by winding said elongated strip onto said first process roll and said second process roll, while joining said second edge of said elongated strip being wound onto said first process roll and said second process roll to said first edge of said elongated strip already wound thereon at said first process roll, until said closed helix has a desired width on said first process roll and said second process roll;

cutting said elongated strip not wound onto said first process roll and said second process roll from said elongated strip previously wound to form said closed helix; and removing said closed helix from said first process roll and said second process roll to obtain said belt.

2. A belt for use in a long nip press for dewatering a fibrous web, said long nip press having a cylindrical press roller and an arcuate pressure shoe which together define a nip therebetween, said belt being passed through said nip in conjunction with at least one pres felt supporting and carrying said fibrous web to be dewatered, said belt being between said press felt and said arcuate pressure shoe in said nip, said belt accordingly having a felt side and a shoe side, said belt comprising:

an elongated strip, said strip being elongated in a longitudinal direction, and having a first edge, a second edge, a constant width and a uniform thickness;

said elongated strip being wound into the form of a closed helix having an axial direction, said elongated strip forming a plurality of successive coils of said closed helix, each of said plurality of successive coils being joined to those in contact therewith by joining said first edge of said elongated strip in each coil to said second edge of said elongated strip in a subsequent coil in said axial direction of said closed helix to form said belt;

wherein said elongated strip comprises a reinforcing web, said reinforcing web having a first side and a second side, said first side being coated with coating of a first polymeric resin, said first coating being uniformly smooth, said first coating on said first side of said reinforcing web being on said shoe side of said belt;

said second side of said reinforcing web being coated with a second coating of a second polymeric resin, said second polymeric resin having a hardness value greater than that of said first polymeric resin, said second coating having at least one groove in said longitudinal direction of said elongated strip, said second coating on said second side of said reinforcing web being on said felt side of said belt; and means for joining said first edge of said elongated strip in each of said plurality of successive coils to said second edge of said elongated strip in a subsequent coil.

3. A belt as claimed in claim 2 wherein said reinforcing web is a fabric strip woven from monofilament yarns of a synthetic polymeric resin.

4. A belt as claimed in claim 3 wherein said monofilament yarns of a synthetic polymeric resin are selected from a group consisting of polyamide and polyester yarns.

5. A belt as claimed in claim 2 wherein said means for joining is an adhesive.

6. A belt as claimed in claim 5 wherein said adhesive is heat-activated.

7. A belt as claimed in claim 5 wherein said adhesive is a urethane-based adhesive.

8. A belt as claimed in claim 2 wherein said first polymeric resin and said second polymeric resin are polyurethane resins.

9. A belt as claimed in claim 2 wherein said second edge of said elongated strip in each of said plurality of successive coils overlaps said first edge of said elongated strip in an adjacent one of said plurality of successive coils to form an extended joint between said coils, said extended joint being wider than said thickness of said elongated strip.

10. A belt as claimed in claim 9 wherein said extended joint is a buttress joint.

11. A belt as claimed in claim 9 wherein said extended joint is a skived joint.

12. A belt a claimed in claim 9 wherein said extended joint is an interlock joint.

* * * * *